US006319060B1

(12) United States Patent
Wu

(10) Patent No.: US 6,319,060 B1
(45) Date of Patent: Nov. 20, 2001

(54) ELECTRICAL CONNECTOR WITH SHIELD INTERFERENTIALLY ENGAGED THERETO

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/660,221

(22) Filed: Sep. 12, 2000

(51) Int. Cl.[7] ..... H01R 13/648
(52) U.S. Cl. ..... 439/607; 439/108
(58) Field of Search ..... 439/607, 108, 439/95

(56) References Cited

U.S. PATENT DOCUMENTS 5,876,247 * 3/1999 Hashimoto ..... 439/607
6,080,016 * 6/2000 Ho et al. ..... 439/607
6,142,833 * 11/2000 Zhu et al. ..... 439/638

* cited by examiner

*Primary Examiner*—Paula Bradley
*Assistant Examiner*—Ann McCamey
(74) *Attorney, Agent, or Firm*—Wei Te Chung

(57) ABSTRACT

An electrical connector (100) comprises an elongate insulative housing (10), a plurality of terminals (40) secured therein, and a metal shield having a first portion (20) and a second portion (30) secured together to the housing. The housing defines a pair of channels (16) in each of a front and rear face (14*a*, 14*b*) thereof, and a slot in end faces (14*c*) thereof. The first portion and the second portion respectively form a pair of front tangs (24) and a pair of rear tangs (32*a*) upwardly extending therefrom for engaging in the channels. A pair of side hooks (26) with engaging fingers (26*a*) extends from opposite edges of the first portion for engaging with the slots, thereby securing the first portion to the front side of the housing. A pair of side plates each with a securing latch (34*b*) secures the second portion tightly to the rear side of the housing.

7 Claims, 5 Drawing Sheets

ELECTRICAL CONNECTOR WITH SHIELD INTERFERENTIALLY ENGAGED THERETO

FIELD OF THE INVENTION

The present invention relates to an electrical connector, and particularly to an electrical connector having a shield interferentially secured thereto.

BACKGROUND OF THE INVENTION

It is well known in the electrical connector field, particularly in the high frequency communications connector field, that metal shells can be used to enclose a dielectric housing and a plurality of contacts received in the housing, thereby reducing the effects of external electromagnetic interference on the signal transmitted through the connector. There are many ways to connect the metal shell to a reference potential such as a grounding point. One way is to form several tabs on the metal shell which electrically connect to a grounding plate of the connector, which in turn electrically connect to the reference potential. The grounding tabs must provide an adequate normal force to ensure that free ends thereof reliably contact the grounding plate. In order to attain adequate normal force, the metal shell is usually formed by first stamping a metal plate to get a flat shell and then bending the flat shell to get a final shell. The final shell usually comprises a portion having two or more layers of plates stacked one above the other, which adds significantly to the height of the connector. This is unacceptable for a mini cable connector, which must have only a very limited height. An improved low profile mini coaxial cable connector is desired to overcome the disadvantages of the prior art. Hence, an improved shield for an electrical connector is required to overcome such disadvantages.

BRIEF SUMMARY OF THE INVENTION

An object of the present invention is to provide a shield for an electrical connector wherein the shield is firmly secured to the connector using interferential means.

Another object of the present invention is to provide a shield which is simple in design and easy to manufacture.

To fulfill the above-mentioned objects, an electrical connector in accordance with the present invention comprises an elongated insulative housing with a plurality of terminals secured therein, and a shield having a first portion and a second portion firmly secured to the housing. The housing defines a pair of channels in both a front and rear faces thereof, and a pair of slots in end faces thereof. The first portion and the second portion respectively form a pair of front tangs and a pair of rear tangs extending upwardly therefrom for engaging in the channels. A pair of side hooks with engaging fingers extends from opposite edges of the first portion for engaging with the slots, thereby securing the first portion to the front side of the housing. A pair of side plates each with a securing latch secures the second portion tightly to the rear side of the housing.

The first portion and the second portion of the shield of the preferred embodiment of present invention are integrally formed from a metal plate.

Other objects, advantages and novel features of the invention will become more apparent from the following detailed description of the present embodiment when taken in conjunction with the accompanying drawings.

DETAILED DESCRIPTION OF THE INVENTION

Figure 1:
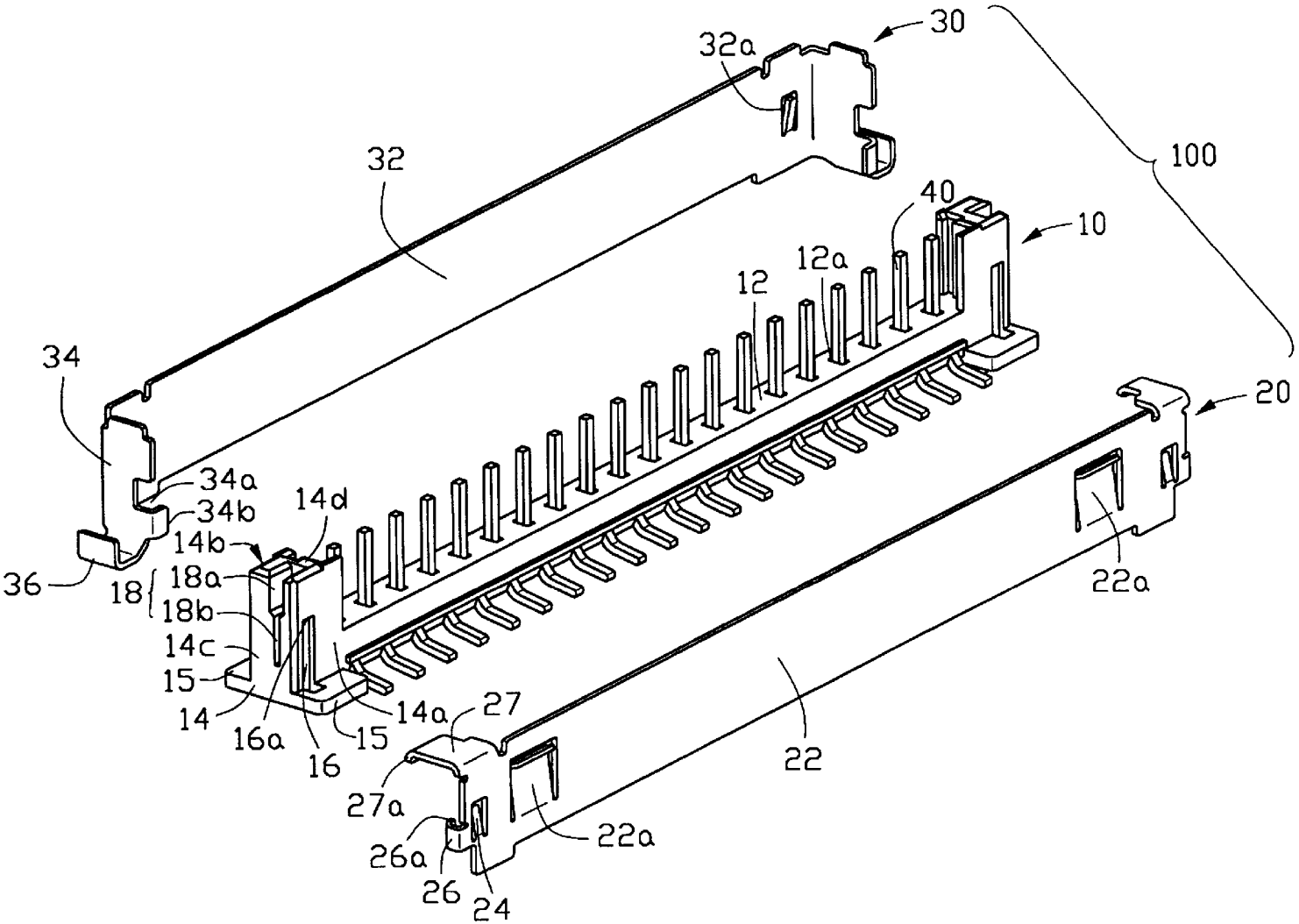
FIG. 1 is an exploded view of an electrical connector in accordance with the present invention.
Figure 2:
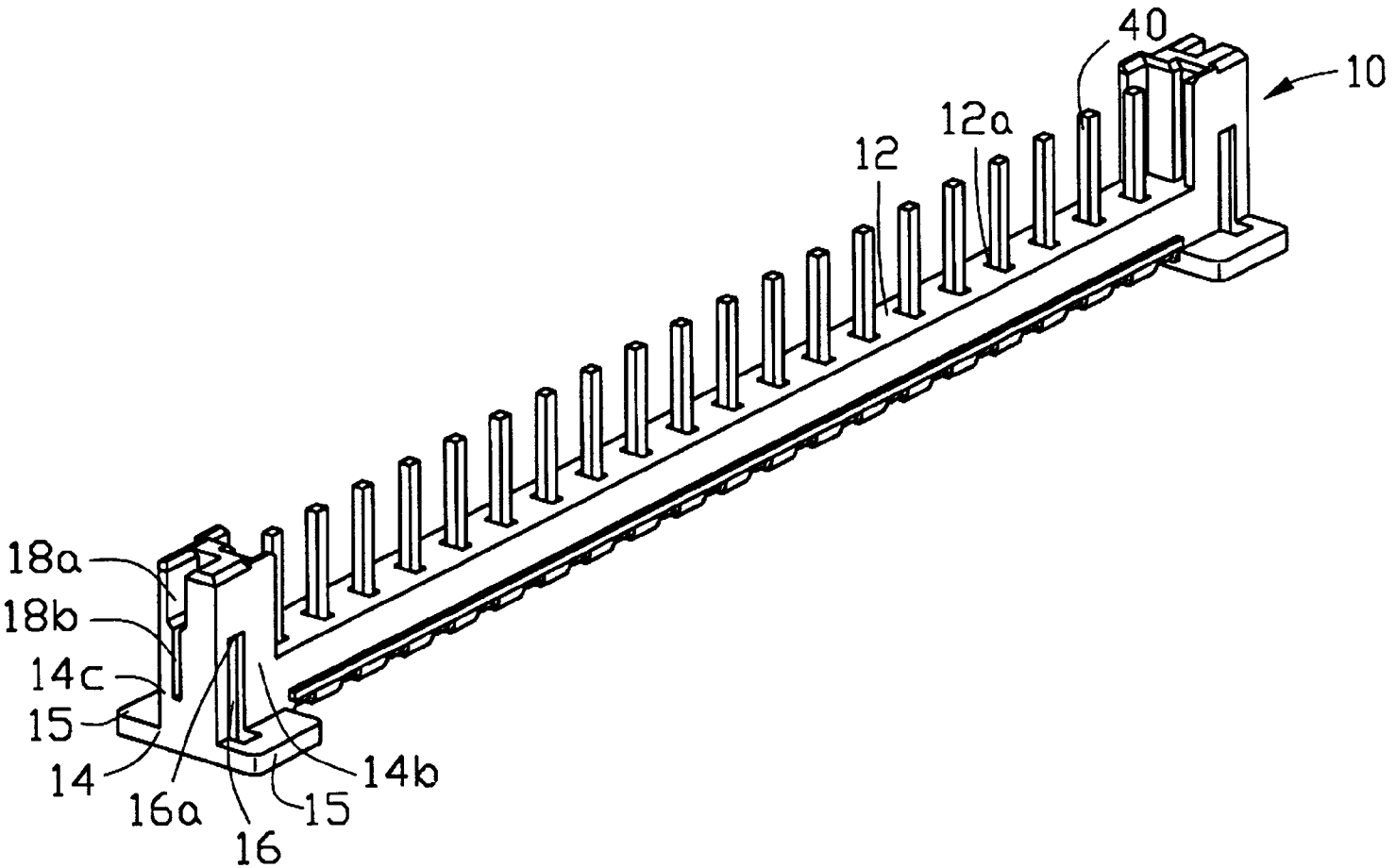
FIG. 2 is a view of the insulative housing of FIG. 1, from another aspect.

Referring to FIGS. 1 and 2, an electrical connector 100 in accordance with the present invention comprises an elongate insulative housing 10, a plurality of terminals 40 secured within the insulative housing 10, and a metal shield for protecting against electromagnetic interference (EMI) having a first portion 20 and a second portion 30.

The insulative housing 10 comprises an elongated body 12 and a pair of upright members 14 unitarily formed with and located at either end of the body 12. The body 12 defines a plurality of retaining holes 12*a* for receiving and retaining corresponding terminals 40. Each upright member 14 has a front face 14*a*, a rear face 14*b*, an end face 14*c* and a top face 14d. Two ears 15 are formed at a base of each upright member 14, and extend respectively from the front face 14*a* and the rear face 14*b*. A vertical channel 16 is defined in each front face 14*a* and in each rear face 14*b* of each upright member 14. A top end of each channel 16 is defined by a stop wall 16*a*. A vertical slot 18 is defined in each upright member 14 in communication with the end face 14*c* and the top face 14d. Each slot 18 comprises an upper portion 18*a* and a lower portion 18*b*, the upper portion 18*a* being wider than the lower portion 18*b*.

Figure 3:
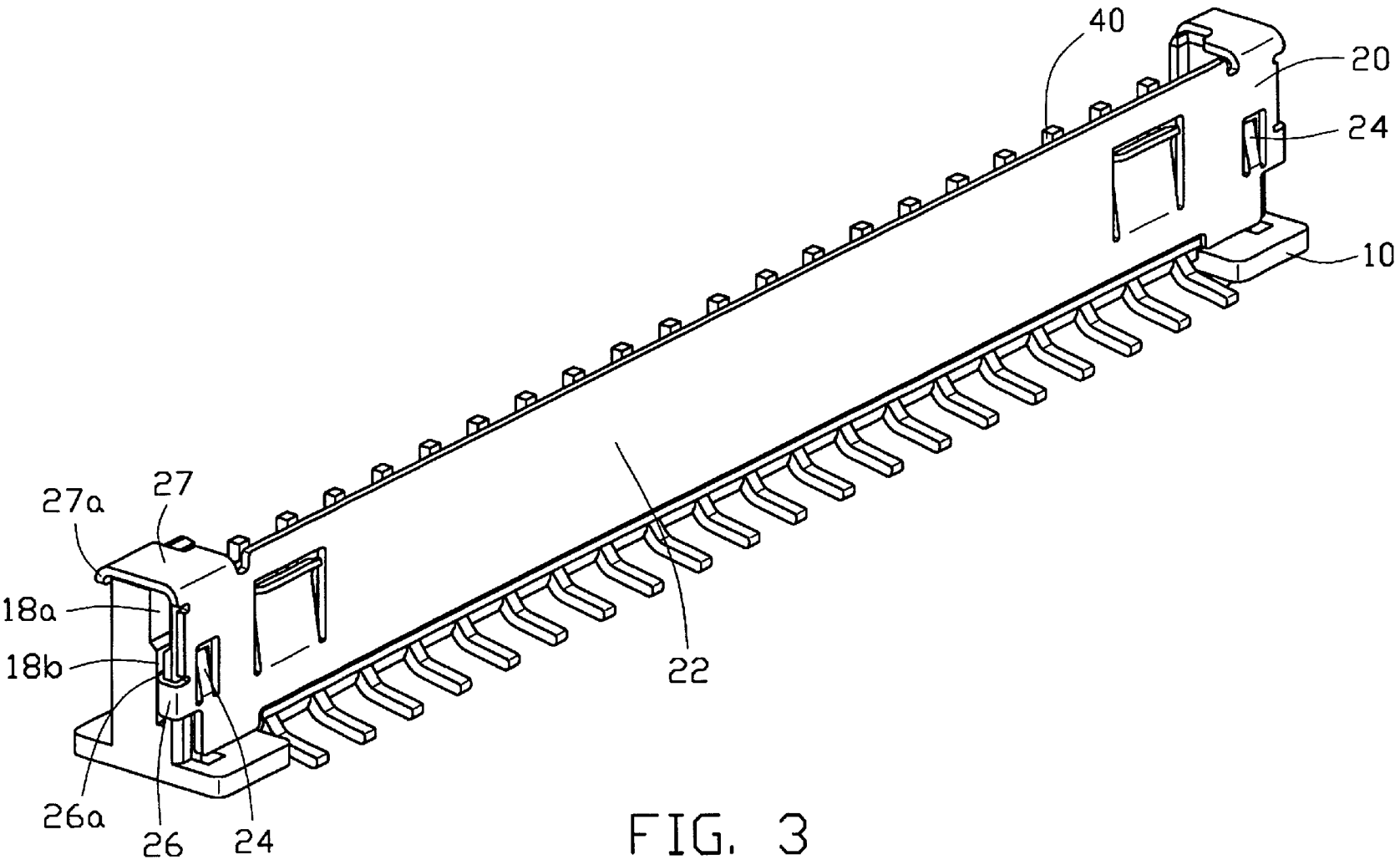
FIG. 3 is a partially assembled view of FIG. 1, without a second portion of the present invention.

Also referring to FIG. 3, the first portion 20 comprises an elongate front plate 22 having two spring arms 22*a* and two front tangs 24 stamped rearwardly in two lateral sides thereof. A pair of side hooks 26 is formed at two lateral edges of the front plate 22. Each side hook 26 bends rearwardly perpendicular to the plane of the front plate 22, and terminates in an engaging finger 26*a* which bends inwardly and parallel to the plane of the front plate 22. A pair of holding plates 27 project rearwardly from an upper edge of the front plate 22, at either lateral side of the front plate 22. A securing tab 27*a* depends from a rearward edge of each holding plate 27.

Figure 4:
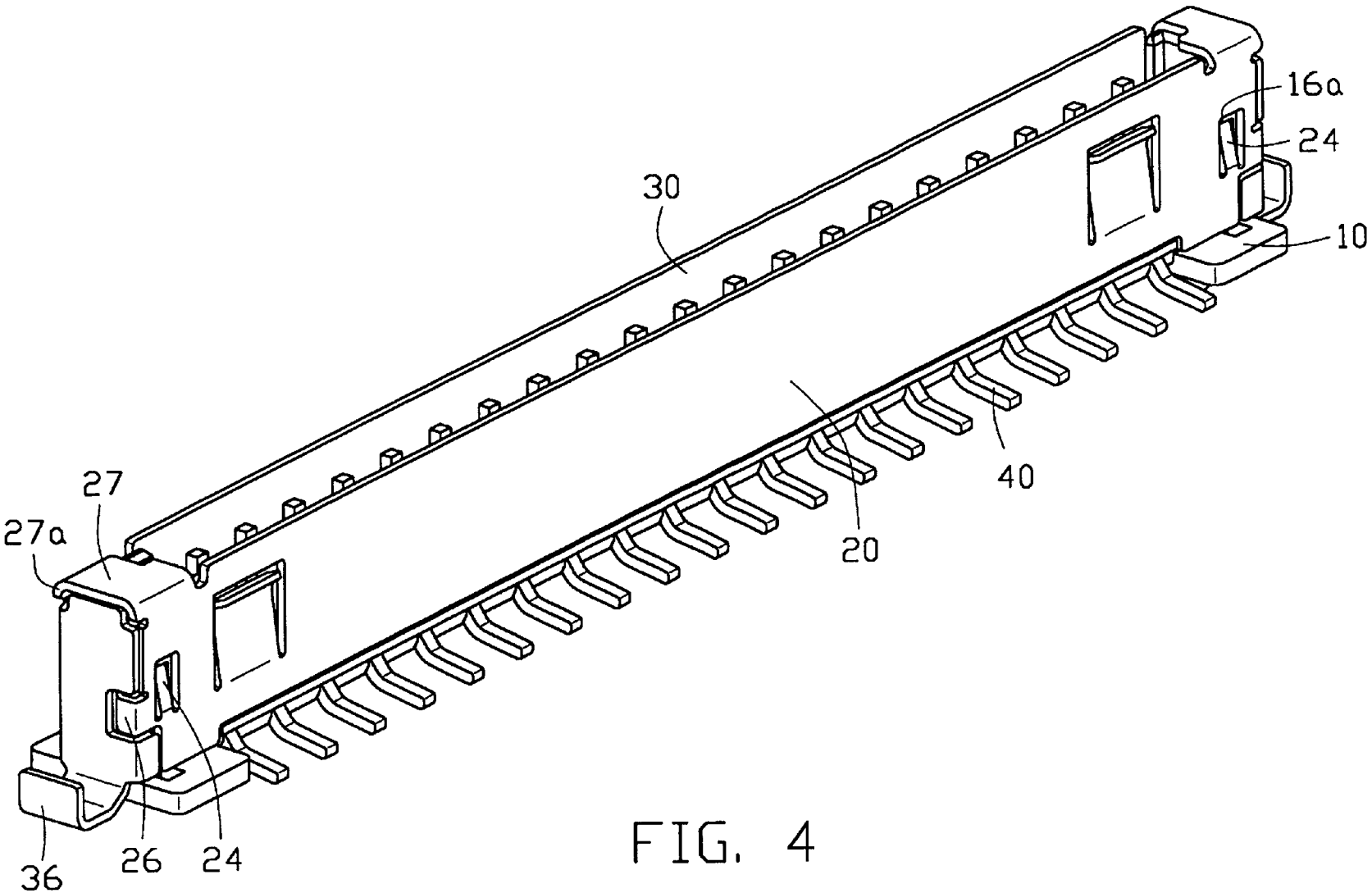
FIG. 4 is a completely assembled view of FIG. 1.

Also referring to FIG. 4, the second portion 30 comprises a rear plate 32 having two rear tangs 32*a* stamped in a forward direction therefrom. A side plate 34 extends perpendicularly from each of two opposite lateral edges of the rear plate 32. Each side plate 34 defines a recess 34*a* in a front edge thereof. A securing latch 34*b* extends perpendicularly inward from the front edge of each side plate 34 below the recess 34*a*. In addition, each side plate 34 forms an arc portion 36 projecting outwardly and upwardly from a lower edge thereof.

Referring to FIGS. 3 and 4, in assembly, the terminals 40 are secured within corresponding retaining holes 12*a* of the insulative housing 10. The first portion 20 is then secured to the insulative housing 10 from the top face 14*d* of the upright members 14 downward. The engaging fingers 26*a* of the side hooks 26 are easily inserted first into the upper portions 18*a* and then into the narrower lower portion 18*b* of the slots 18. The front tangs 24 snap into the channels 16 and abut against the stop walls 16*a* thereof. The holding plates 27 tightly abut the top faces 14*d* and the securing tabs 27*a* tightly press the rear faces 14*b* of the upright members 14. The front tangs 24, the side hooks 26, and the holding plates 27 and securing tabs 27*a* tightly secure the first portion 20 to the front faces 14*a* of the upright members 14. The second portion 30 is assembled to the insulative housing from the direction of the rear faces 14*b* of the upright members 14. The side plates 34 of the second portion 30 are pressed outwardly and slide over respective end faces 14*c* of the upright members 14 until the securing latches 34*b* snap into their places, fitting tightly against respective front faces 14*a*. In this position the recesses 34*a* of the side plates 34 will each fixedly accommodate a corresponding side hook 26 of the first portion 20. The rear tangs 32*a* of the second portion 30 snap into the channels 16 in the rear faces 14*b* of the corresponding upright members 14, abutting against corresponding stop walls 16*a*. Both the pair of rear tangs 32*a* fitting against the stop walls 16*a* in the rear faces 14*b*, and the securing latches 34*b* fitting against corresponding side hooks 26 of the first portion 20 prevent the second portion 30 from moving in an upward direction. The side plates 34 tightly cover the end faces 14*c* of the upright members 14 and the securing latches 34*b* tightly press the front faces 14*a* of the upright members 14, holding the second portion 30 tightly against the upright member 14. Note that the side plates 34 also help to prevent movement of the first portion 20 upward, by interfering with upward movement of the upright members 14.

Figure 5:
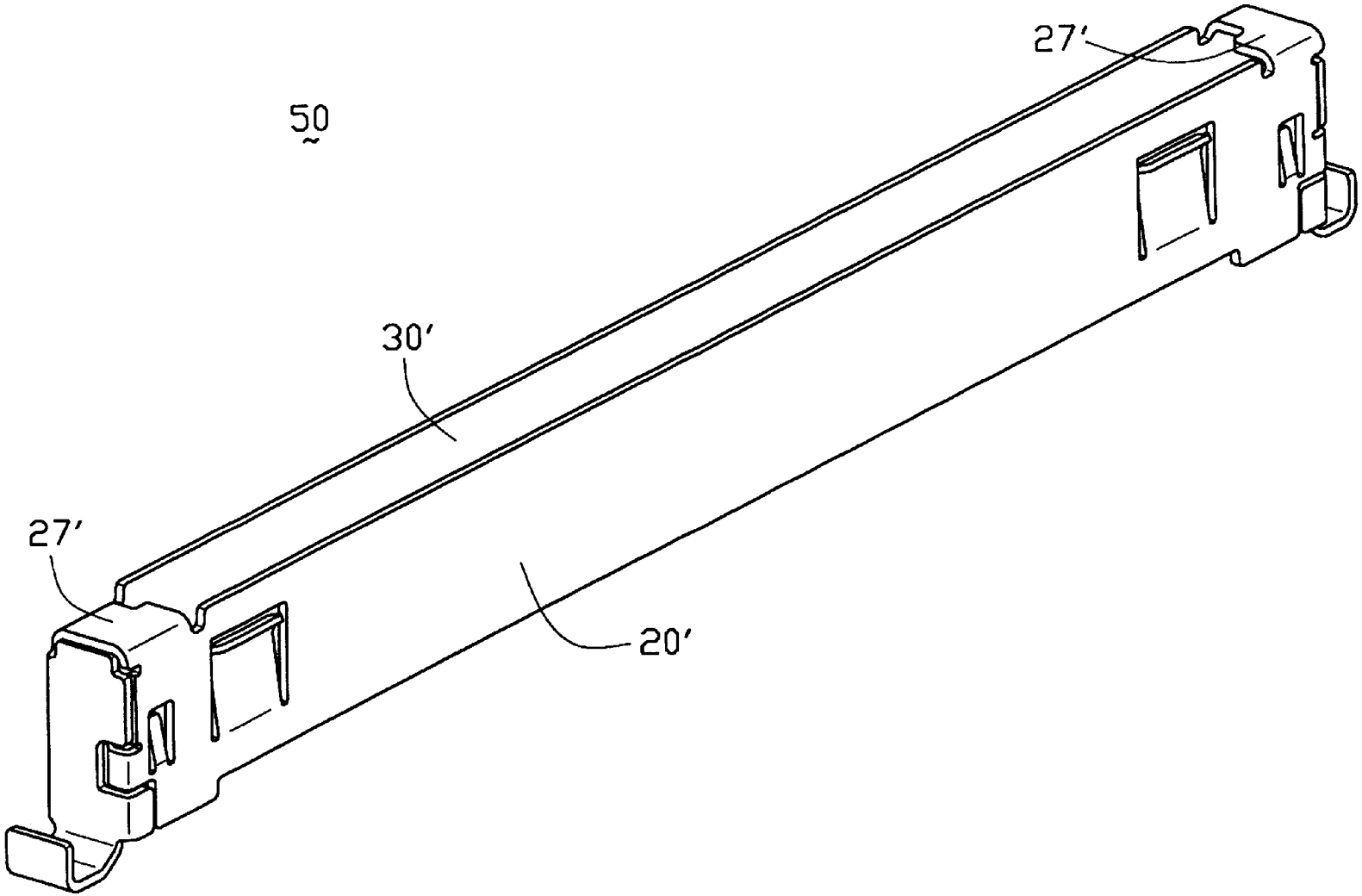
FIG. 5 is a perspective view of the shield of another embodiment of the present invention.

FIG. 5 shows a shield 50 of another embodiment of the present invention. The shield 50 is integrally formed from a metal plate, and comprises a first portion 20' and a second portion 30' connected by two holding plates 27'.

According to the above features of the present invention, the first portion 20 and second portion 30 of the electrical connector 100 are respectively secured to the housing 10 from different directions, which directions are perpendicular to each other (namely, a first direction being from the top downward for a first portion 20 and a second direction being from the rear toward the front for the second portion 30). This securing arrangement assures a secure locking relationship therebetween. In addition, the shield is integrally formed from a pair of metal plates and has a relatively simple structure with respect to the prior art designs. This decreases the manufacturing and assembling costs of the shield.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector comprising:

an insulating housing having an elongated body with a plurality of terminals assembled therein;

a shield assembled to said housing and including a first portion assembled to the housing along a first direction, said first portion including a front tang extending to engage with said housing, and a second portion assembled to the housing along a second direction which is perpendicular to the first direction, said second portion including a rear tang extending to engage with said housing, the first and second portions of the shield defining an elongated receiving space for receiving the elongated body of the housing;

wherein a movement of the second portion opposite the first direction is limited by the first portion engaged to the housing and a movement of the first portion opposite the first direction is limited by the second portion when the second portion is assembled to the housing.

2. An electrical connector comprising:

an insulative housing having an elongate body, the elongate body having two opposite faces and two opposite end faces, each of the two opposite end faces defining at least a slot therein, and each of the two opposite side faces defining at least a channel therein;

a plurality of terminals secured within the insulative housing; and a shield having a first portion and a second portion, wherein the first portion comprises a first plate having at least a first tang and a engaging finger thereof respectively inserting into the channel and the slot thereby securing the first portion to a selected one of the two opposite side faces of the insulative housing and preventing the first portion from disengaging form the insulative housing; and the second portion comprises a second plate forming a second tang thereof and a securing latch extending from an edge of the second plate toward the insulative housing, the second portion being secured to the other of the two opposite side faces and the second tang bearing against the other of the two opposite side faces of the insulative housing, the first portion and the second portion cooperatively and generally enclosing the insulative housing; wherein each slot comprises an upper portion and a lower portion, the upper portion being wider than the lower portion, and wherein the engaging finger is formed on a lateral edge of the first plate and is connected with the lateral edge of the first plate by a side hook, and the second plate defines a recess to allow the side hook to extend therethrough.

3. The electrical connector as claimed in claim 2, wherein the first plate further comprises a holding plate for holding on a top face of the insulative housing, the holding plate downwardly forming a securing tab from a free end thereof for holding on the other of the two opposite side of the insulative housing.

4. The electrical connector as claimed in claim 2, wherein the second plate forms a side plate perpendicularly extending from each of two opposite lateral edges thereof for holding on the end faces of the insulative housing, and the securing latch is formed on a front edge of each side plate for holding on the selected one of the two opposite side faces of the insulative housing.

5. The electrical connector as claimed in claim 2, wherein the insulative housing respectively defines a channel in each of the two opposite side faces, the first tang of the first portion extending into the channel in the one of the two opposite side faces to prevent the first portion from moving upward.

6. The electrical connector as claimed in claim 5, wherein the second tang of the second plate extends toward the insulative housing for extending into and securing in the channel defined in the other of the two opposite side faces of the insulative housing.

7. An electrical connector comprising:

an insulative housing defining an elongated body, a pair of upright members positioned at two opposite ends thereof, and a plurality of terminals therein;

each of said upright members defining a slot and a channel therein, both said slots and said channels extending in a vertical direction perpendicular to the longitudinal direction of said elongated body; and a shield assembled to the housing, said shield including an elongated plate with a pair of tangs and a pair of side hooks disposed around two opposite ends thereof; wherein each of said pair of tangs is latchably engaged within the corresponding channels and used to prevent upward movement of the shield relative to the housing alone the vertical direction, and the side hooks are retainably received within the corresponding slots and prevent lateral movement of the shield relative to the housing perpendicular to said vertical direction.

* * * * *